US010378327B2

(12) United States Patent
Lin et al.

(10) Patent No.: US 10,378,327 B2
(45) Date of Patent: Aug. 13, 2019

(54) METHOD FOR GAS EXTRACTION ALTERNATING OSCILLATING PULSE HIGH ENERGY GAS EXTRACTION WITH THERMAL INJECTION

(71) Applicant: CHINA UNIVERSITY OF MINING AND TECHNOLOGY, Jiangsu (CN)

(72) Inventors: Baiquan Lin, Jiangsu (CN); Quanle Zou, Jiangsu (CN); Ting Liu, Jiangsu (CN); Chang Guo, Jiangsu (CN); Chuanjie Zhu, Jiangsu (CN); Jia Kong, Jiangsu (CN); Fazhi Yan, Jiangsu (CN); Hao Yao, Jiangsu (CN); Yidou Hong, Jiangsu (CN)

(73) Assignee: CHINA UNIVERSITY OF MINING AND TECHNOLOGY (CN)

( * ) Notice: Subject to any disclaimer, the term of this patent is extended or adjusted under 35 U.S.C. 154(b) by 60 days.

(21) Appl. No.: 15/321,891

(22) PCT Filed: Dec. 22, 2015

(86) PCT No.: PCT/CN2015/098153
§ 371 (c)(1),
(2) Date: Dec. 23, 2016

(87) PCT Pub. No.: WO2016/110185
PCT Pub. Date: Jul. 14, 2016

(65) Prior Publication Data

US 2018/0209259 A1 Jul. 26, 2018

(30) Foreign Application Priority Data

Jan. 6, 2015 (CN) ..... 2015 1 0005776

(51) Int. Cl.
*E21B 36/00* (2006.01)
*E21B 43/24* (2006.01)
(Continued)

(52) U.S. Cl.
CPC ..... *E21B 43/267* (2013.01); *E21B 36/006* (2013.01); *E21B 43/2405* (2013.01); *E21F 7/00* (2013.01); *E21B 43/114* (2013.01)

(58) Field of Classification Search
CPC .. E21B 36/006; E21B 43/2405; E21B 43/267; E21F 7/00
See application file for complete search history.

(56) References Cited

U.S. PATENT DOCUMENTS 2,786,660 A * 3/1957 Alleman ..... E21B 43/295 166/256
4,026,356 A * 5/1977 Shuck ..... E21B 7/14 166/245
7,445,045 B2 * 11/2008 East, Jr. ..... E21B 43/006 166/254.2

FOREIGN PATENT DOCUMENTS

CN 1676870 10/2005 ..... E21B 43/241
CN 101832149 9/2010 ..... E21B 43/24
(Continued)

OTHER PUBLICATIONS

International Search Report (w/translation) and Written Opinion (no translation) issued in application No. PCT/CN2015/098153, dated Apr. 1, 2016 (10 pgs).

*Primary Examiner* — Matthew R Buck
(74) *Attorney, Agent, or Firm* — Hayes Soloway P.C.

(57) ABSTRACT

A gas extraction method in which high energy gas fracturing technology is used to form a fracture network in a thermal injection borehole. Then high-pressure, cyclically temperature-changing steam is injected into the borehole using a spinning oscillating-pulse jet nozzle to form oscillating superheated steam, alternatingly impacting and heating the coal body. The high energy gas forms a fracture network that provides channels for passage of the superheated steam, while oscillating changes in steam temperature and pressure
(Continued)

also promote crack propagation and perforation of the coal body; the combined effect of alternation of the two enhances gas desorption and extraction efficiency.

10 Claims, 4 Drawing Sheets

(51) Int. Cl.

| | |
|---|---|
| ***E21B 43/267*** | (2006.01) |
| ***E21F 7/00*** | (2006.01) |
| *E21B 43/114* | (2006.01) |

(56) References Cited

FOREIGN PATENT DOCUMENTS

| | | | | |
|---|---|---|---|---|
| CN | 103206199 | 7/2013 | ..... | E21B 43/247 |
| CN | 104632270 | 5/2015 | ..... | E21B 43/24 |
| EP | 2527586 | 11/2012 | ..... | E21B 36/00 |

* cited by examiner

METHOD FOR GAS EXTRACTION ALTERNATING OSCILLATING PULSE HIGH ENERGY GAS EXTRACTION WITH THERMAL INJECTION

FIELD OF THE INVENTION

The present invention relates to a method for gas extraction by alternating oscillation pulsed high-energy gas fracturing and heat injection, which is applicable to gas control in micro-porous, low-permeability, high-absorptivity high gas coal seam areas under coal mines.

BACKGROUND OF THE INVENTION

Most coal seams in China have characteristics including high gas pressure, high gas content, low permeability, and strong absorptivity, and it is very difficult to extract gas from the coal seams. Therefore, it is an important approach to improve permeability manually for the coal seams to improve air permeability of the coal seams and improve the gas pre-extraction rate, in order to ensure safe production in the coal mines.

At present, hydraulic measures have been widely applied in the gas control process in the coal mining fields in China, owing to their efficient pressure relief and permeability improvement effect. However, hydraulic measures still have drawbacks such as limited fracturing capability of jet flow impact, high water demand, water accumulation in roadways, and high requirement for borehole sealing, etc.; consequently, the scope of influence of a single borehole is limited, the construction load of boreholes is still not decreased significantly, and the requirement for intensive coal mining can't be met.

A gas flowing at a high speed has characteristics including high compressibility. When a high-energy gas is released instantaneously, the gas will expand and release great energy. However, when a high-energy gas directly impacts a coal mass, the coal mass can be fractured only if the impact strength reaches the compression strength of the coal mass. Consequently, the fracturing effect of direct gas impact is not remarkable.

Relevant researches have demonstrated that the gas absorptivity of a coal mass decreases by about 8% whenever the temperature increases by 1° C. In recent years, many researchers have put forward heat injection-based coal seam gas extraction techniques, which increase the temperature of a coal mass by injecting high-temperature stream into a coal seam, and thereby promote gas desorption. However, owing to the fact that the heat-conduction coefficient of coal mass is not high and the heat injection form is simple, the engineering application effect of these heat injection-based coal seam gas extraction techniques is not remarkable.

CONTENTS OF THE INVENTION

Technical Problem

In order to overcome the drawbacks in the prior art, the present invention provides a method for gas extraction by alternating oscillation pulsed high-energy gas fracturing and heat injection, which has high practicability, involves low construction load, and can remarkably improve the gas extraction efficiency.

Technical Solution

The method for gas extraction by alternating oscillation pulsed high-energy gas fracturing and heat injection provided in the present invention comprises: first, arranging extraction borehole sites in a grid manner towards the coal seam direction; then, drilling extraction boreholes, sealing the extraction boreholes, and connecting the extraction boreholes into a gas extraction pipe network for gas extraction, sequentially; the method further comprises the following steps:

a. arranging fracturing and heat injection borehole sites at the intersections centers of extraction boreholes in the grid manner which has finished construction, drilling at each of the fracturing and heat injection borehole sites with a drilling machine till the drill bit passes through the roof of the coal seam, and then withdrawing the drill stem;

b. inserting a steel pipe with a spinning oscillation pulsed jet nozzle mounted on the pipe head into the fracturing and heat injection borehole till the pipe head reaches to a position at 1 m distance to the roof of the coal seam, pre-sealing the borehole for the steel pipe, and connecting the fracturing and the heat injection borehole to the gas extraction pipe network through an extraction pipeline mounted with an extraction pipeline valve;

c. connecting the exposed end of the steel pipe to a high-pressure gas station and a steam generator via a tee joint, closing the valve and a valve on a hot steam transmission pipeline of the steam generator first, and then opening a valve on a high-energy gas pipeline of the high-pressure gas station, so that the high-pressure gas in the high-pressure gas station enters into the steel pipe via the tee joint, is jetted from the spinning oscillation pulsed jet nozzle and forms a high-energy oscillation pulsed jet stream to impact and fracture the coal mass in the fracturing and heat injection borehole;

d. then, closing the valve on the high-energy gas pipeline, opening the valve on the extraction pipeline, and carrying out gas extraction from the fracturing and heat injection borehole;

e. closing the valve on the extraction pipeline and opening the valve on the hot steam transmission pipeline when the gas concentration in the fracturing and heat injection borehole is lower than 30%; starting the steam generator and injecting hot steam into the fracturing and heat injection borehole for 1 to 2 h, and then shutting down the steam generator and closing the valve on the hot steam transmission pipeline to stop the heat injection;

f. opening the valve on the extraction pipeline, and carrying out gas extraction from the fracturing and heat injection borehole again;

g. repeating the steps c, d, e, and f when the gas concentration in the fracturing and heat injection borehole is lower than 30% again, till the gas concentration in the fracturing and heat injection borehole is always lower than 30%; then, withdrawing the steel pipe so that the spinning oscillation pulsed jet nozzle is moved towards the borehole orifice direction by 2 to 2.5 m;

h. repeating the steps c, d, e, f, and g, till the spinning oscillation pulsed jet nozzle is returned to a position at 1 m distance to the floor of the coal seam; then, terminating the high-energy gas fracturing and heat injection in the fracturing and heat injection borehole.

The spinning oscillation pulsed jet nozzle comprises a nozzle inlet, an oscillation cavity, and a nozzle outlet, wherein, the nozzle inlet has two stages of hole wall inclination transition from outside to inside, and the nozzle outlet has three stages of hole wall inclination transition from inside to outside.

The spinning oscillation pulsed jet nozzle is connected with the steel pipe via a bearing, with a waterproof seal ring mounted between them.

The hot steam temperature injected into the fracturing and heat extraction borehole is at 100 to 500° C.

The outer wall of the steel pipe is cladded with a glass wool insulation layer.

Beneficial Effects

With the technical solution described above, the method disclosed in the present invention adopts a spinning oscillation pulsed jet nozzle to jet a high-pressure gas to form a high-energy oscillation pulsed jet stream, which impacts and fractures the coal mass, promotes the propagation of protogenetic fissures in the coal mass and creates new fissures, so that the fissures perforate and form a fissure network, and thereby the scope of disturbance around a single borehole is enlarged and the effect of gas extraction from a single borehole is improved. The super-heated steam jetted through the spinning oscillating pulsed nozzle creates oscillatory varying steam pressure, which promotes further propagation and perforation of the fissures, so that the fissures form a fissure network more extensively; the hot steam injected into the coal mass heats up the coal mass through the fissure network, decreases the adsorption potential of the gas in the coal mass and improves the gas desorption capability, and thereby the gas extraction effect is improved significantly. The method disclosed in the present invention overcomes the limitation of the single permeability improvement technique, significantly enlarges the scope of disturbance around a single borehole by means of a high-energy gas fracturing technique, and forms a fissure network that provides flow channels for the super-heated steam, while the oscillatory varying steam temperature and pressure promotes fissure propagation and perforation in the coal mass; under the synergetic effect of the alternating operations, the gas desorption efficiency is improved significantly, and efficient gas extraction is realized. The method has high practicability, is especially suitable for use in gas control in micro-porous, low-permeability, high-absorptivity high gas coal seam areas, and has an extensive application prospect.

Figure 1:
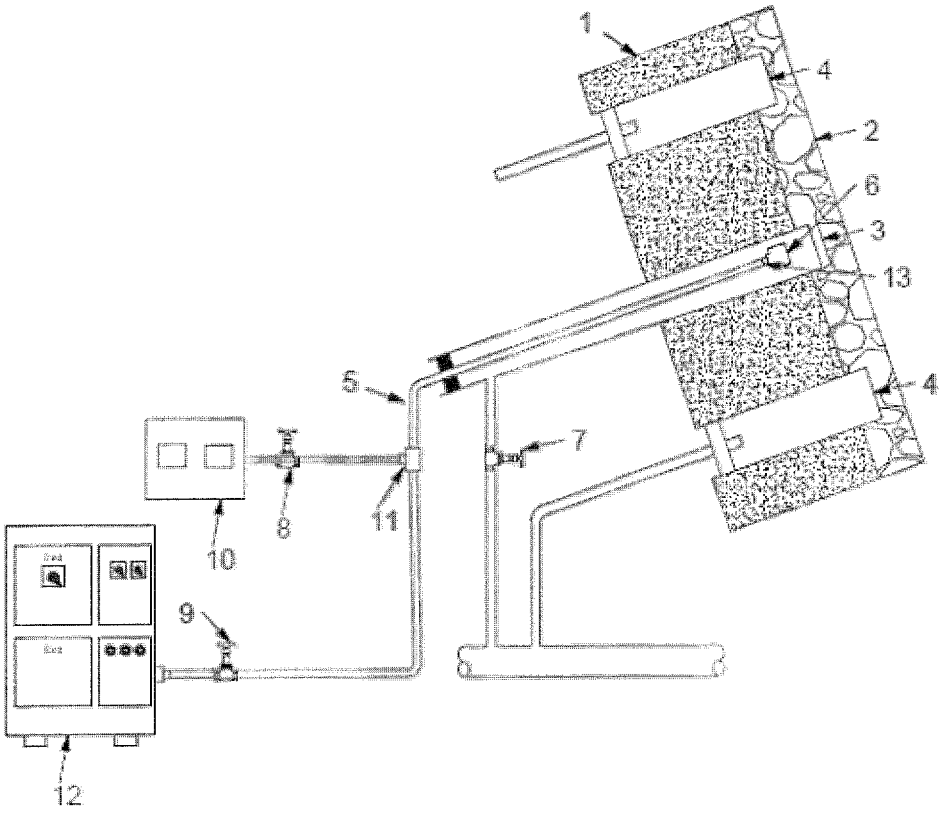
FIG. 1 is a schematic diagram of the implementation method according to the present invention.
Figure 2:
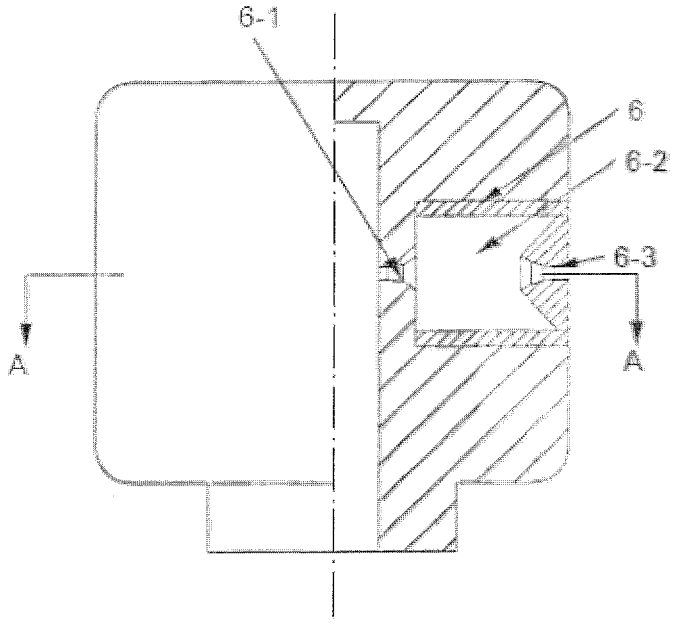
FIG. 2 is a schematic structural diagram of the spinning oscillation pulsed jet nozzle.
Figure 3:
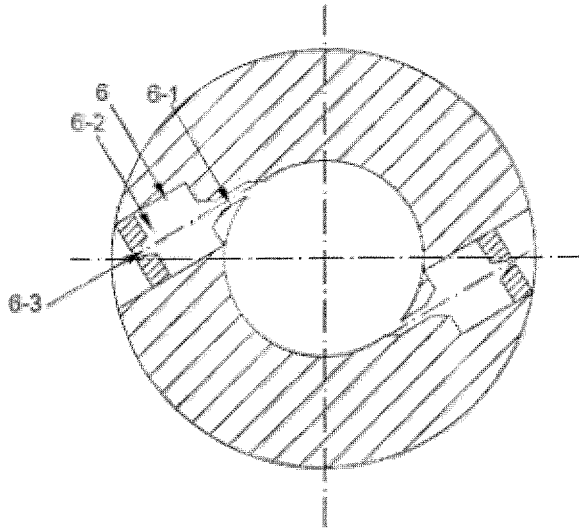
FIG. 3 is a sectional view in A-A direction of the structure shown in FIG. 2.
Figure 4:
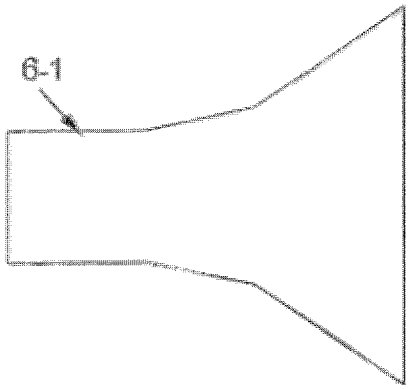
FIG. 4 is a schematic diagram of the nozzle inlet of the spinning oscillation pulsed jet nozzle.
Figure 5:
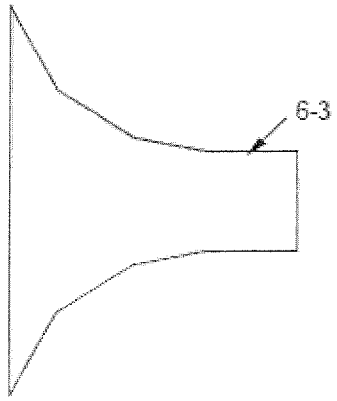
FIG. 5 is a schematic diagram of the nozzle outlet of the spinning oscillation pulsed jet nozzle.

Among the figures: 1—coal seam; 2—roof of coal seam; 3—fracturing and heat injection borehole; 4—ordinary extraction borehole; 5—steel pipe; 6—spinning oscillation pulsed jet nozzle; 6-1—nozzle inlet; 6-2—oscillation cavity; 6-3—nozzle outlet; 7—valve on extraction pipeline; 8—valve on high-energy gas pipeline; 9—valve on hot steam transmission pipeline; 10—high-pressure gas station; 11—tee joint; 12—steam generator; 13—bearing.

DETAILED DESCRIPTION OF THE EMBODIMENTS

Hereunder the present invention will be detailed in an embodiment with reference to the accompanying drawings.

The method for gas extraction by alternating oscillation pulsed high-energy gas fracturing and heat injection provided in the present invention comprises the following steps:

a. first, arranging sites of extraction boreholes 4 in a grid manner towards the direction of the coal seam 1, and then drilling the extraction boreholes 4, sealing the extraction boreholes 4, and connecting the extraction boreholes 4 to a gas extraction pipe network for gas extraction, sequentially;

b. arranging fracturing and heat injection borehole 3 at the intersections centers of extraction boreholes 4 in the grid manner which has finished construction, drilling at each of the sites of fracturing and heat injection boreholes 3 with a drilling machine till the drill bit passes through the roof of the coal seam 2, and then withdrawing the drill stem;

c. inserting a steel pipe 5 with a spinning oscillation pulsed jet nozzle 6 mounted on the pipe head into the fracturing and heat injection borehole 3 till the pipe head reaches to a position at 1 m distance to the roof of the coal seam 2, pre-sealing the borehole for the steel pipe 5, and connecting the fracturing and the heat injection borehole 3 to the gas extraction pipe network through an extraction pipeline mounted with an extraction pipeline valve 7; the outer wall of the steel pipe 5 is cladded with a glass wool insulation layer.

d. connecting the exposed end of the steel pipe 5 to a high-pressure gas station 10 and a steam generator 12 via a tee joint 11, closing the valve 7 on the extraction pipeline and a valve 9 on a hot steam transmission pipeline of the steam generator 12 first, and then opening a valve 8 on a high-energy gas pipeline of the high-pressure gas station 10, so that the high-pressure gas in the high-pressure gas station 10 enters into the steel pipe 5 via the tee joint 11, is jetted from the spinning oscillation pulsed jet nozzle 6 and forms a high-energy oscillation pulsed jet stream to impact and fracture the coal mass in the fracturing and heat injection borehole 3; wherein, the spinning oscillation pulsed jet nozzle 6 is connected with the steel pipe 5 via a bearing 13, the spinning oscillation pulsed jet nozzle 6 comprises a nozzle inlet 6-1, an oscillation cavity 6-2, and a nozzle outlet 6-3, wherein, the nozzle inlet 6-1 has two stages of hole wall inclination transition from outside to inside, and the nozzle outlet 6-3 has three stages of hole wall inclination transition from inside to outside, the air stream jetted from the nozzle outlet 6-3 generates a counterforce against the spinning oscillation pulsed jet nozzle 6, and the tangential component of the counterforce drives the spinning oscillation pulsed jet nozzle 6 to spin automatically after the jetting; the spinning oscillation pulsed jet nozzle 6 is connected with the steel pipe 5 via the bearing 13, with a waterproof seal ring mounted between them;

e. then, closing the valve 8 on the high-energy gas pipeline, opening the valve 7 on the extraction pipeline, and carrying out gas extraction from the fracturing and heat injection borehole 3;

f. closing the valve 7 on the extraction pipeline and opening the valve 9 on the hot steam transmission pipeline when the gas concentration in the fracturing and heat injection borehole 3 is lower than 30%; starting the steam generator 12 and injecting 100 to 500° C. super-heated steam into the fracturing and heat injection borehole 3 for 1 to 2 h, and then shutting down the steam generator 12 and closing the valve 9 on the hot steam transmission pipeline to stop the heat injection;

g. opening the valve 7 on the extraction pipeline, and carrying out gas extraction from the fracturing and heat injection borehole 3 again;

h. repeating the steps d, e, f, and g when the gas concentration in the fracturing and heat injection borehole 3 is lower than 30% again, till the gas concentration in the fracturing and heat injection borehole 3 is always lower than 30%; then, withdrawing the steel pipe 5 so that the spinning oscillation pulsed jet nozzle 6 is moved towards the borehole orifice direction by 2 to 2.5 m;

i. repeating the steps d, e, f, g, and h, till the spinning oscillation pulsed jet nozzle 6 is returned to a position at 1 m distance to the floor of the coal seam; then, terminating the high-energy gas fracturing and heat injection in the fracturing and heat injection borehole 3.

The invention claimed is:

1. A method for gas extraction by alternating oscillation pulsed high-energy gas fracturing and heat injection, comprising: first, arranging sites of extraction boreholes in a grid manner towards a direction of a coal seam, and then drilling the extraction boreholes, sealing the extraction boreholes, and connecting the extraction boreholes to a gas extraction pipe network for gas extraction, sequentially; wherein, the method further comprises the following steps:

a. arranging fracturing and heat injection borehole at the intersections centers of extraction boreholes in the grid manner which has finished construction, drilling at each of the sites of fracturing and heat injection boreholes with a drilling machine till a drill bit of the drilling machine passes through the roof of the coal seam, and then withdrawing a drill stem of the drilling machine;

b. inserting a steel pipe with a spinning oscillation pulsed jet nozzle mounted on a pipe head of the steel pipe into the fracturing and heat injection borehole till the pipe head reaches a spaced distance from the roof of the coal seam, pre-sealing the borehole for the steel pipe, and connecting the fracturing and heat injection borehole to the gas extraction pipe network through an extraction pipeline mounted with an extraction pipeline valve;

c. connecting the exposed end of the steel pipe to a high-pressure gas station and a steam generator via a tee joint, closing the valve on the extraction pipeline and a valve on a hot steam transmission pipeline of the steam generator first, and then opening a valve on a high-energy gas pipeline of the high-pressure gas station, so that the high-pressure gas in the high-pressure gas station enters into the steel pipe via the tee joint, is jetted from the spinning oscillation pulsed jet nozzle and forms a high-energy oscillation pulsed jet stream to impact and fracture the coal mass in the fracturing and heat injection borehole;

d. then, closing the valve on the high-energy gas pipeline, opening the valve on the extraction pipeline, and carrying out gas extraction from the fracturing and heat injection borehole;

e. closing the valve on the extraction pipeline and opening the valve on the hot steam transmission pipeline when the gas concentration in the fracturing and heat injection borehole is below a predetermined percentage; starting the steam generator and injecting hot steam into the fracturing and heat injection borehole, and then shutting down the steam generator and closing the valve on the hot steam transmission pipeline to stop the heat injection;

f. opening the valve on the extraction pipeline, and carrying out gas extraction from the fracturing and heat injection borehole again;

g. repeating the steps c, d, e, and f when the gas concentration in the fracturing and heat injection borehole is again below the predetermined percentage, till the gas concentration in the fracturing and heat injection borehole is always lower than said predetermined percentage; then, withdrawing the steel pipe so that the spinning oscillation pulsed jet nozzle is moved in a direction towards the borehole orifice;

h. repeating the steps c, d, e, f, and g, till the spinning oscillation pulsed jet nozzle is returned to a spaced distance from the floor of the coal seam; then, terminating the high-energy gas fracturing and heat injection in the fracturing and heat injection borehole.

2. The method according to claim 1, wherein, the spinning oscillation pulsed jet nozzle comprises a nozzle inlet, an oscillation cavity, and a nozzle outlet, the nozzle inlet has two stages of hole wall inclination transition from outside to inside, and the nozzle outlet has three stages of hole wall inclination transition from inside to outside.

3. The method according to claim 1, wherein, the spinning oscillation pulsed jet nozzle is connected with the steel pipe via a bearing, with a waterproof seal ring mounted between them.

4. The method according to claim 1, wherein, the hot steam temperature injected into the fracturing and heat extraction borehole is at 100 to 500° C.

5. The method according to claim 1, wherein, the outer wall of the steel pipe is cladded with a glass wool insulation layer.

6. The method according to claim 1, wherein said spaced distance from the roof is about 1 m.

7. The method according to claim 1, wherein said predetermined percentage is lower than 30%.

8. The method according to claim 1, wherein said spinning oscillation pulsed jet nozzle is moved in the direction towards the borehole orifice by 2 to 2.5 m.

9. The method according to claim 1, wherein said spaced distance from the floor is about 1 m.

10. The method according to claim 1, wherein in step e, the hot steam is injected into the fracturing and heat injection borehole for 1 to 2 h.

* * * * *